US009745543B2

(12) United States Patent
Hunt, Jr. et al.

(10) Patent No.: US 9,745,543 B2
(45) Date of Patent: Aug. 29, 2017

(54) STABLE LIQUID MANUAL DISHWASHING COMPOSITIONS CONTAINING ENZYMES

(75) Inventors: Clinton Hunt, Jr., Lakeville, MN (US); Victor Fuk-Pong Man, St. Paul, MN (US); Steven Eugene Lentsch, St. Paul, MN (US); Lylien Tan, Maplewood, MN (US); Yvonne Marie Killeen, South St. Paul, MN (US); Terrence P. Everson, Eagan, MN (US)

(73) Assignee: Ecolab USA Inc., Saint Paul, MN (US)

( * ) Notice: Subject to any disclaimer, the term of this patent is extended or adjusted under 35 U.S.C. 154(b) by 619 days.

(21) Appl. No.: 13/608,324

(22) Filed: Sep. 10, 2012

(65) Prior Publication Data

US 2014/0073036 A1 Mar. 13, 2014

(51) Int. Cl.
*C11D 3/386* (2006.01)
*C11D 1/88* (2006.01)

(52) U.S. Cl.
CPC ..... *C11D 1/88* (2013.01); *C11D 3/38663* (2013.01)

(58) Field of Classification Search
CPC ..... C11D 1/88; C11D 3/38663
See application file for complete search history.

(56) References Cited

U.S. PATENT DOCUMENTS

| | | | | |
|---|---|---|---|---|
| 5,156,761 | A | 10/1992 | Aaslyng et al. | |
| 5,531,917 | A * | 7/1996 | Nakayama | C11D 3/38663 134/18 |
| 5,851,973 | A * | 12/1998 | Foley | 510/235 |
| 5,858,946 | A | 1/1999 | Foley et al. | |
| 5,877,141 | A | 3/1999 | Gabriel et al. | |
| 6,022,381 | A | 2/2000 | Dias et al. | |
| 6,046,152 | A | 4/2000 | Vinson et al. | |
| 6,069,122 | A | 5/2000 | Vinson et al. | |
| 6,087,309 | A | 7/2000 | Vinson et al. | |
| 6,239,093 | B1 | 5/2001 | Foley et al. | |
| 6,309,426 | B1 | 10/2001 | Dias et al. | |
| 6,365,561 | B1 | 4/2002 | Vinson et al. | |
| 6,398,821 | B1 | 6/2002 | Dias et al. | |
| 6,525,034 | B2 | 2/2003 | Dalrymple et al. | |
| 6,540,791 | B1 | 4/2003 | Dias | |
| 6,624,132 | B1 | 9/2003 | Man et al. | |
| 7,018,660 | B2 | 3/2006 | Murad | |
| 7,169,745 | B2 | 1/2007 | Kasturi et al. | |
| 7,214,650 | B2 | 5/2007 | Kasturi et al. | |
| 7,241,729 | B2 | 7/2007 | Sivik et al. | |
| 7,439,217 | B2 | 10/2008 | Boutique et al. | |
| 7,479,475 | B2 | 1/2009 | de Buzzaccarini et al. | |
| 7,678,753 | B2 * | 3/2010 | Maki | C11D 3/0047 510/303 |
| 7,737,105 | B2 | 6/2010 | Delplancke et al. | |
| 7,915,212 | B2 | 3/2011 | Yeung et al. | |
| 7,939,601 | B1 | 5/2011 | Bergeron et al. | |
| 2002/0053110 | A1 | 5/2002 | Dias et al. | |
| 2002/0124329 | A1 | 9/2002 | Pratt | |
| 2003/0087787 | A1 * | 5/2003 | Man et al. | 510/392 |
| 2004/0029757 | A1 * | 2/2004 | Levitt et al. | 510/235 |
| 2004/0142840 | A1 | 7/2004 | de Buzzaccarini et al. | |
| 2004/0192832 | A1 | 9/2004 | Cordier | |
| 2004/0266650 | A1 | 12/2004 | Lambotte et al. | |
| 2005/0124738 | A1 | 6/2005 | Sivik et al. | |
| 2005/0215449 | A1 | 9/2005 | Penninger et al. | |
| 2006/0210612 | A1 | 9/2006 | Simon et al. | |
| 2006/0293212 | A1 | 12/2006 | Griese et al. | |
| 2007/0036832 | A1 * | 2/2007 | Williams et al. | 424/405 |
| 2007/0089244 | A1 | 4/2007 | Penninger | |
| 2007/0136954 | A1 | 6/2007 | Penninger et al. | |
| 2008/0075684 | A1 | 3/2008 | Barg et al. | |
| 2009/0269395 | A1 | 10/2009 | Lintner et al. | |
| 2010/0011519 | A1 | 1/2010 | Warkotsch et al. | |
| 2010/0120658 | A1 | 5/2010 | Schiedel et al. | |
| 2011/0015110 | A1 | 1/2011 | Kellar et al. | |
| 2011/0065624 | A1 | 3/2011 | Boutique et al. | |
| 2011/0166370 | A1 | 7/2011 | Saunders et al. | |
| 2011/0209291 | A1 | 9/2011 | Sadlowski et al. | |
| 2011/0220537 | A1 | 9/2011 | Fernandez-Prieto et al. | |
| 2011/0224455 | A1 | 9/2011 | Fernandez Prieto et al. | |
| 2011/0240510 | A1 | 10/2011 | De Poortere et al. | |
| 2011/0319310 | A1 | 12/2011 | Labeque | |
| 2011/0319311 | A1 | 12/2011 | Labeque et al. | |
| 2011/0319314 | A1 | 12/2011 | Labeque et al. | |
| 2012/0014885 | A1 | 1/2012 | Collier et al. | |
| 2012/0058166 | A1 | 3/2012 | Glenn, Jr. et al. | |

FOREIGN PATENT DOCUMENTS

| | | | |
|---|---|---|---|
| DE | 286181 | A5 | 10/1983 |
| DE | 102 46 713 | A1 | 4/2004 |
| DE | 103 01 575 | A1 | 7/2004 |
| DE | 20 2006 007 594 | U1 | 8/2006 |
| DE | 10 2005 056 230 | A1 | 5/2007 |
| EP | 0352244 | A2 | 1/1990 |
| EP | 0 405 901 Al | A1 | 1/1991 |
| EP | 0 781 839 | A1 | 7/1997 |
| EP | 1 629 825 | A1 | 3/2006 |
| WO | WO 91/00910 | A1 | 1/1991 |
| WO | WO 97/24107 | A1 | 7/1997 |
| WO | WO 97/24108 | A1 | 7/1997 |
| WO | WO 97/39089 | A1 | 10/1997 |
| WO | WO 98/05742 | A1 | 2/1998 |
| WO | WO 98/27945 | A1 | 7/1998 |

(Continued)

OTHER PUBLICATIONS

English Abstract—EP 0 405 901 A1—Unilever PLC, issued Jan. 2, 1991.

(Continued)

*Primary Examiner* — Lisa J Hobbs
(74) *Attorney, Agent, or Firm* — McKee, Voorhees & Sease, PLC

(57) ABSTRACT

Liquid stable enzyme compositions and methods of employing the same for cleaning, including warewashing and dishwashing, are disclosed. The stable enzyme compositions preferably employ an amphoteric surfactant stabilizing agent, such as disodium camphodiacetate (CADA), to stabilize a mixture of traditionally unstable enzymes, such as proteases and lipases.

19 Claims, 2 Drawing Sheets

(56) References Cited

FOREIGN PATENT DOCUMENTS

| | | | |
|---|---|---|---|
| WO | WO 98/35004 | A1 | 8/1998 |
| WO | WO 99/33946 | A1 | 7/1999 |
| WO | WO 01/28508 | A1 | 4/2001 |
| WO | WO 01/62221 | A1 | 8/2001 |
| WO | WO 01/72271 | A2 | 10/2001 |
| WO | WO 03/085074 | A1 | 10/2003 |
| WO | WO 2007/010478 | A2 | 1/2007 |
| WO | WO 2008/079855 | A2 | 7/2008 |
| WO | WO 2008/145446 | A1 | 12/2008 |
| WO | WO 2010/006995 | A1 | 6/2010 |
| WO | WO 2011/086532 | A1 | 7/2011 |

OTHER PUBLICATIONS

Novozymes—Household Care—A guide to Novozymes Household Care, Denmark, retrieved from the Internet on Jul. 19, 2012: novozymes.com (39 pages).

Ecolab USA Inc., PCT/US2013/057843 filed Sep. 3, 2013, "Notification of Transmittal of The International Search Report and The Written Opinion of the International Searching Authority, or the Declaration" mailed Dec. 13, 2013.

European Patent Office, "Extended European Search Report", issued in connection to 13835673.8-1375/2893013, mailed Mar. 11, 2016, 7 pages.

* cited by examiner

STABLE LIQUID MANUAL DISHWASHING COMPOSITIONS CONTAINING ENZYMES

FIELD OF THE INVENTION

The invention relates to liquid stable enzyme compositions for cleaning, including warewashing and dishwashing. In particular, the compositions include the enzyme stabilizing agent disodium camphodiacetate (CADA) to allow the use of mixtures of traditionally unstable enzymes, such as proteases and lipases. The use of CADA further improves stabilization of enzymes already employing a stabilization mechanism. Methods of using the liquid stable enzyme compositions are also disclosed.

BACKGROUND OF THE INVENTION

Dishmachines have to effectively clean a variety of articles such as pots and pans, glasses, plates, bowls, and utensils. These articles include a variety of soils including protein, fat, starch and sugar, which can be difficult to remove. At times, these soils may be burnt or baked on, or otherwise thermally degraded. Other times, the soil may have been allowed to remain on the surface for a period of time, making it more difficult to remove. Dishmachines remove soil by using a combination of detergents, temperatures, sanitizers or mechanical action from water.

Often enzymes are employed to assist in soil removal. Enzymes present an alternative to aggressive chemistries for cleaning a variety of articles and difficult to remove soils. Often enzymes are employed to replace a surfactant to enhance soil removal and provide a more sustainable detergent composition, such as those that are phosphate-free. But, a challenge to enzymes is maintaining their stability in solution in the presence of water or incompatible chemistries. In order to market an aqueous enzyme composition, the enzyme must be stabilized so that it will retain its functional activity for prolonged periods of time (e.g. shelf-life or storage). Enzymes are generally unstable in solution without a stabilizing system and therefore require excess amounts of enzymes to compensate for the expected loss. This is undesirable due to the high cost of enzymes.

Enzyme instability in solution may result from incompatible chemistry (e.g. surfactants and antimicrobials) denaturing the enzyme, or autolysis in the presence of protease where the protease attacks other enzymes. Enzyme stabilization systems exist but have drawbacks. For example, boric acid or borate stabilization systems are restricted in certain countries. It is against this background that this invention is made.

Accordingly, it is an objective of the invention to develop improved enzyme compositions for use in soil removal in dishmachines.

A further object of the invention is to provide liquid stable enzyme compositions for warewashing, dishwashing and other cleaning applications requiring the use of enzymes, namely synergistic combinations of enzymes for a particular cleaning application, regardless of whether one or more of the enzymes are stabilized using an alternative mechanism (e.g. stabilized protease enzymes).

BRIEF SUMMARY OF THE INVENTION

In an embodiment, the present invention includes a stabilized liquid enzyme composition comprising: an enzyme stabilizing agent, wherein said agent is an amphoteric surfactant; and a combination of more than one enzyme, wherein the composition does not have loss in performance for at least about 40 days. In an aspect of the invention, the compositional stability of the compositions is measured enzymes in the composition retaining at least about 80% of its initial enzyme activity after 40 days at room temperature.

In a further embodiment, the present invention includes a stabilized liquid enzyme composition comprising: an imidazoline-derived amphoteric surfactant enzyme stabilizing agent; a combination of more than one enzyme; and a solvent; wherein the composition has compositional stability for at least 40 days, and wherein the ratio the enzyme stabilizing agent to the enzymes is from about 1:1 to about 64:1.

In a still further embodiment, the present invention includes methods of cleaning comprising: applying a liquid stable enzyme composition to an article to be cleaned, wherein the liquid stable enzyme composition comprises an imidazoline-derived amphoteric surfactant enzyme stabilizing agent, a combination of enzymes including a protease enzyme, and a solvent, wherein the composition has compositional stability for at least 40 days, and wherein the ratio the enzyme stabilizing agent to the enzymes is from about 1:1 to about 64:1.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
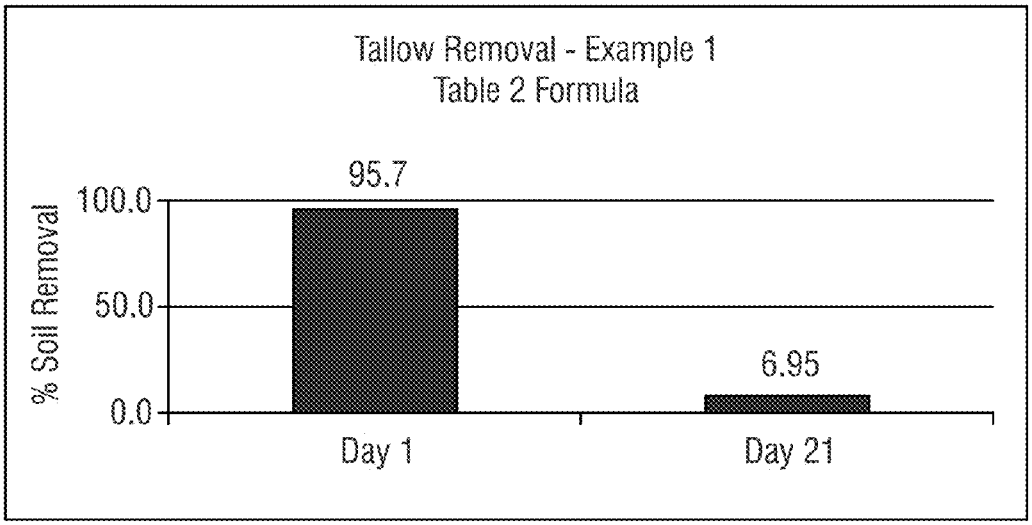
FIGS. 1-2 show the efficacy of soil removal obtained from the formulas employing the stabilized enzyme compositions according to the invention over extended periods of time in comparison to non-stabilized enzyme compositions.

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENT

The present invention relates to liquid stable enzyme compositions. The compositions have many advantages over conventional enzyme cleaning compositions. For example, the liquid stable enzyme compositions combine enzymes into a single cleaning composition having shelf-stability for an unexpected extended period of time. An enzyme stabilizer (disodium camphodiacetate (CADA)) is employed in the cleaning compositions to allow the combined use of traditionally unstable enzymes, such as proteases and lipases.

The embodiments of this invention are not limited to particular cleaning compositions and/or methods of employing the same, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, the term "alkyl" or "alkyl groups" refers to saturated hydrocarbons having one or more carbon atoms, including straight-chain alkyl groups (e.g., methyl, ethyl, propyl, butyl, pentyl, hexyl, heptyl, octyl, nonyl, decyl, etc.), cyclic alkyl groups (or "cycloalkyl" or "alicyclic" or "carbocyclic" groups) (e.g., cyclopropyl, cyclopentyl, cyclohexyl, cycloheptyl, cyclooctyl, etc.), branched-chain alkyl groups (e.g., isopropyl, tert-butyl, sec-butyl, isobutyl, etc.), and alkyl-substituted alkyl groups (e.g., alkyl-substituted cycloalkyl groups and cycloalkyl-substituted alkyl groups).

Unless otherwise specified, the term "alkyl" includes both "unsubstituted alkyls" and "substituted alkyls." As used herein, the term "substituted alkyls" refers to alkyl groups having substituents replacing one or more hydrogens on one or more carbons of the hydrocarbon backbone. Such substituents may include, for example, alkenyl, alkynyl, halogeno, hydroxyl, alkylcarbonyloxy, arylcarbonyloxy, alkoxycarbonyloxy, aryloxy, aryloxycarbonyloxy, carboxylate, alkylcarbonyl, arylcarbonyl, alkoxycarbonyl, aminocarbonyl, alkylaminocarbonyl, dialkylaminocarbonyl, alkylthiocarbonyl, alkoxyl, phosphate, phosphonato, phosphinato, cyano, amino (including alkyl amino, dialkylamino, arylamino, diarylamino, and alkylarylamino), acylamino (including alkylcarbonylamino, arylcarbonylamino, carbamoyl and ureido), imino, sulfhydryl, alkylthio, arylthio, thiocarboxylate, sulfates, alkylsulfinyl, sulfonates, sulfamoyl, sulfonamido, nitro, trifluoromethyl, cyano, azido, heterocyclic, alkylaryl, or aromatic (including heteroaromatic) groups. The term "alkoxy" refers to a straight or branched chain monovalent hydrocarbon radical having a specified number of carbon atoms and a carbon-oxygen-carbon bond, may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanoyl, carbanoyloxy, cyano, methylsulfonylamino, or halogen, for example. Examples include methoxy, ethoxy, propoxy, t-butoxy, and the like.

In some embodiments, substituted alkyls can include a heterocyclic group. As used herein, the term "heterocyclic group" includes closed ring structures analogous to carbocyclic groups in which one or more of the carbon atoms in the ring is an element other than carbon, for example, nitrogen, sulfur or oxygen. Heterocyclic groups may be saturated or unsaturated. Exemplary heterocyclic groups include, but are not limited to, aziridine, ethylene oxide (epoxides, oxiranes), thiirane (episulfides), dioxirane, azetidine, oxetane, thietane, dioxetane, dithietane, dithiete, azolidine, pyrrolidine, pyrroline, oxolane, dihydrofuran, and furan.

As used herein, the term "disinfectant" refers to an agent that kills all vegetative cells including most recognized pathogenic microorganisms, using the procedure described in *A. O. A. C. Use Dilution Methods*, Official Methods of Analysis of the Association of Official Analytical Chemists, paragraph 955.14 and applicable sections, 15th Edition, 1990 (EPA Guideline 91-2). As used herein, the term "high level disinfection" or "high level disinfectant" refers to a compound or composition that kills substantially all organisms, except high levels of bacterial spores, and is effected with a chemical germicide cleared for marketing as a sterilant by the Food and Drug Administration. As used herein, the term "intermediate-level disinfection" or "intermediate level disinfectant" refers to a compound or composition that kills mycobacteria, most viruses, and bacteria with a chemical germicide registered as a tuberculocide by the Environmental Protection Agency (EPA). As used herein, the term "low-level disinfection" or "low level disinfectant" refers to a compound or composition that kills some viruses and bacteria with a chemical germicide registered as a hospital disinfectant by the EPA.

As used herein, the term "microorganism" refers to any noncellular or unicellular (including colonial) organism. Microorganisms include all prokaryotes. Microorganisms include bacteria (including cyanobacteria), spores, lichens, fungi, protozoa, virinos, viroids, viruses, phages, and some algae. As used herein, the term "microbe" is synonymous with microorganism. For the purpose of this patent application, successful microbial reduction is achieved when the microbial populations are reduced by at least about 50%, or by significantly more than is achieved by a wash with water. Larger reductions in microbial population provide greater levels of protection.

As used herein, the term "sanitizer" refers to an agent that reduces the number of bacterial contaminants to safe levels as judged by public health requirements. In an embodiment, sanitizers for use in this invention will provide at least a 99.999% reduction (5-log order reduction). These reductions can be evaluated using a procedure set out in *Germicidal and Detergent Sanitizing Action of Disinfectants*, Official Methods of Analysis of the Association of Official Analytical Chemists, paragraph 960.09 and applicable sections, 15th Edition, 1990 (EPA Guideline 91-2). According to this reference a sanitizer should provide a 99.999% reduction (5-log order reduction) within 30 seconds at room temperature, 25±2° C., against several test organisms.

As used in this invention, the term "sporicide" refers to a physical or chemical agent or process having the ability to cause greater than a 90% reduction (1-log order reduction) in the population of spores of *Bacillus cereus* or *Bacillus subtilis* within 10 seconds at 60° C. In certain embodiments, the sporicidal compositions of the invention provide greater than a 99% reduction (2-log order reduction), greater than a 99.99% reduction (4-log order reduction), or greater than a 99.999% reduction (5-log order reduction) in such population within 10 seconds at 60° C.

As used herein, the term "substantially free" refers to compositions completely lacking the component or having such a small amount of the component that the component does not affect the performance of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%. In an aspect of the invention, the liquid stabilized enzyme compositions are substantially free of additional enzyme stabilizers known in the art, including those disclosed herein.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both.

As used herein, the term "ware" refers to items such as eating and cooking utensils, dishes, and other hard surfaces such as showers, sinks, toilets, bathtubs, countertops, windows, mirrors, transportation vehicles, and floors. As used herein, the term "warewashing" refers to washing, cleaning, or rinsing ware. Ware also refers to items made of plastic. Types of plastics that can be cleaned with the compositions according to the invention include but are not limited to, those that include polycarbonate polymers (PC), acrilonitrile-butadiene-styrene polymers (ABS), and polysulfone polymers (PS). Another exemplary plastic that can be cleaned using the compounds and compositions of the invention include polyethylene terephthalate (PET).

As used herein, the term "waters" includes food process or transport waters. Food process or transport waters include produce transport waters (e.g., as found in flumes, pipe transports, cutters, slicers, blanchers, retort systems, washers, and the like), belt sprays for food transport lines, boot and hand-wash dip-pans, third-sink rinse waters, and the like. Waters also include domestic and recreational waters such as pools, spas, recreational flumes and water slides, fountains, and the like.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods and compositions of the present invention may comprise, consist essentially of, or consist of the component and ingredients of the present invention as well as other ingredients described herein. As used herein, "consisting essentially of" means that the methods and compositions may include additional steps, components or ingredients, but only if the additional steps, components or ingredients do not materially alter the basic and novel characteristics of the claimed methods and compositions.

While an understanding of the mechanism is not necessary to practice the present invention and while the present invention is not limited to any particular mechanism of action, it is contemplated that, in some embodiments, use of the amphoteric enzyme stabilizer (e.g. disodium camphodiacetate) complexes with the protein in order to deactivate the enzymes. For example, according to a mechanism of the invention, the amphoteric enzyme stabilizer stops a protease enzyme from degrading a lipase enzyme included in the same composition, providing prolonged enzyme stability. In addition to the benefit of preventing enzyme deactivation, the enzyme stabilizer also permits ambient temperatures, neutral pH and non-irritating compositions of traditionally unstable mixtures of enzymes. Beneficially, the use of the surfactant enzyme stabilizer allows a mixture of enzymes particularly suited for removal of various fatty soils in warewashing applications, namely the combined use of proteases and lipases.

The liquid stable enzyme compositions provide enhanced enzyme stabilizer in comparison to existing stabilized compositions, including for example those employing organic monocarboxylic acids, boric acid, borate salts, compositions having reduced water content, and/or calcium and magnesium-stabilized systems. In an aspect of the invention, the liquid stable enzyme compositions are substantially free of the conventional enzyme stabilizers. Additional description of various enzyme stabilizing systems are disclosed in U.S. Pat. Nos. 3,697,451, 4,753,748, 6,069,122, 6,624,132, 7,553,806 and 7,569,532 which are incorporated by reference herein in their entirety.

In an alternative aspect of the invention, the liquid stable enzyme compositions are used in combination with a stabilized enzyme, such as for example a stabilized protease enzyme. The stabilized protease Coronase is available from Novozymes A/S as described more fully in U.S. patent application Ser. No. 12/934,355. In certain embodiments of the invention, the liquid stable enzyme composition employs both a lipase and a stabilized protease, providing additional benefits of stabilization for the composition.

Liquid Stable Enzyme Compositions

According to an embodiment of the invention the compositions include a surfactant stabilizing agent and a mixture of enzymes. In an embodiment the surfactant stabilizing agent is an amphoteric surfactant. In an embodiment the mixture of enzymes includes a combination of two or more of the following enzymes: protease, amylase, lipase, gluconase, cellulase and/or peroxidase. In a preferred aspect, the combination of enzymes includes a protease, a lipase and/or an amylase and the surfactant stabilizing agent is an amphoteric surfactant.

In an aspect of the invention, the stabilized enzyme compositions retain compositional stability for a few months, for at least about 6 months, for more than at least 6 months. In certain embodiments the liquid formulations according to embodiments of the invention are stable for at least 1 year. As referred to herein, compositional stability means that the enzymes in the liquid stable enzyme composition retain at least about 80% of its initial enzyme activity at ambient temperature, preferably at least about 90% of its initial enzyme activity, preferably at least about 95% of its initial enzyme activity, and most preferably 100% of its initial enzyme activity.

Amphoteric Surfactants

In an aspect of the invention, the surfactant stabilizing agent is an amphoteric surfactant. Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia" Cosmetics & Toiletries, Vol. 104 (2) 69-71 (1989), which is incorporated herein by reference.

The first class of amphoteric surfactants includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives having application in the present invention generally have the general formula:

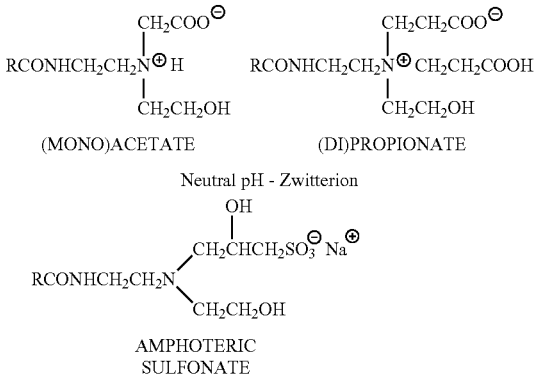

wherein R is an acyclic hydrophobic group containing from about 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Amphocarboxylic acids can be produced from fatty imidazolines in which the dicarboxylic acid functionality of the amphodicarboxylic acid is diacetic acid and/or dipropionic acid.

Additionally suitable amphoteric imidazole derivatized surfactants include, for example, disodium lauroamphodiacetate, disodium cocoamphodiacetate, sodium cocoamphoacetate, sodium stearoamphoacetate, sodium lauroamphoacetate, disodium capryloamphodiacetate, sodium mixed C8 amphocarboxylate, sodium cocoamphoproprionate, cocoampho dipropionic acid, disodium cocoampho dipropionate, sodium capryloampho propionate, alkyl amidoamine carboxylate, disodium capryloampho dipropionate, sodium cocoampho hydroxypropyl sulfonate, and sodium capryloampho hydroxypropyl sulfonate.

The carboxymethylated compounds (glycinates) described herein above frequently are called betaines. Betaines are a special class of amphoteric discussed herein below in the section entitled, Zwitterion Surfactants. According to an embodiment of the invention, betaine and sultaine surfactants suitable for use as the amphoteric enzyme stabilizer have the following general formula:

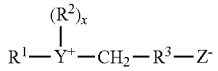

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Suitable betaines (which are also carboxylates) and sultaine surfactants include for example, alkyl betaines, alkylamidopropyl betaines, aminopropionates and sultaines. Additional suitable examples may include dihydroxyethyl glycinate. The various betaines and sultaine may optionally be based on fatty amines and fatty amine ethoxylates as opposed to imidazolines. Commercially-available surfactants as described herein are available under the trade name Mirataine® and Miranol® (Rhodia, Solvay Group).

Long chain N-alkylamino acids are readily prepared by reaction $RNH_2$, in which $R{=}C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine Examples of commercial N-alkylamino acid ampholytes having application in this invention include alkyl beta-amino dipropionates, $RN(C_2H_4COOM)_2$ and $RNHC_2H_4COOM$. In an embodiment, R can be an acyclic hydrophobic group containing from about 8 to about 18 carbon atoms, and M is a cation to neutralize the charge of the anion.

Suitable amphoteric surfactants include those derived from coconut products such as coconut oil or coconut fatty acid. Additional suitable coconut derived surfactants include as part of their structure an ethylenediamine moiety, an alkanolamide moiety, an amino acid moiety, e.g., glycine, or a combination thereof; and an aliphatic substituent of from about 8 to 18 (e.g., 12) carbon atoms. Such a surfactant can also be considered an alkyl amphodicarboxylic acid. These amphoteric surfactants can include chemical structures represented as: $C_{12}$-alkyl-C(O)—NH—$CH_2$—$CH_2$—$N^+$($CH_2$—$CH_2$—$CO_2Na)_2$—$CH_2$—$CH_2$—OH or $C_{12}$-alkyl-C(O)—N(H)—$CH_2$—$CH_2$—$N^+$($CH_2$—$CO_2Na)_2$—$CH_2$—$CH_2$—OH. Disodium cocoampho dipropionate is one suitable amphoteric surfactant and is commercially available under the tradename Miranol™ FBS from Rhodia Inc., Cranbury, N.J. Another suitable coconut derived amphoteric surfactant with the chemical name disodium cocoampho diacetate is sold under the tradename Mirataine™ JCHA, also from Rhodia Inc., Cranbury, N.J. Various additional coconut-derived amphoteric surfactants are commercially available under the following tradenames: Amphosol® 2C (a mild amphoteric surfactant which also acts as a foam booster and viscosity builder) (Stepan Company), Mesoteric™ C-2 (Mason Chemical Company), Proteric™ CDX-38 (Protameen Chemicals, Inc.), Mackam® 2C (Rhodia Inc.), and the like.

A typical listing of amphoteric classes, and species of these surfactants, is given in for example in U.S. Pat. No. 3,929,678, which is incorporated herein by reference in its entirety. Further examples are given in "Surface Active Agents and Detergents" (Vol. I and II by Schwartz, Perry and Berch), which is further incorporated herein by reference in its entirety.

In a preferred embodiment, the surfactant stabilizing agent is disodium camphodiacetate (CADA). In an aspect, the compositions may include at least 1-50 wt-% amphoteric enzyme stabilizer, at least 5-50 wt-% amphoteric enzyme stabilizer, preferably at least 10-30 wt-% amphoteric enzyme stabilizer.

Enzymes

The liquid stable enzyme compositions include at least one enzyme, preferably the compositions employ a combination of enzymes which can provide desirable activity for removal of soils. In an aspect, the combination of enzymes provide desirable activity for the removal of protein-based, carbohydrate-based, and/or triglyceride-based soils from substrates, such as for example, flatware, cups and bowls, and pots and pans. Enzymes can act by degrading or altering one or more types of soil residues encountered on a surface thus removing the soil or making the soil more removable. Both degradation and alteration of soil residues can improve detergency by reducing the physicochemical forces which bind the soil to the surface being cleaned, i.e. the soil becomes more water soluble. For example, one or more proteases can cleave complex, macromolecular protein structures present in soil residues into simpler short chain molecules which are, of themselves, more readily desorbed from surfaces, solubilized, or otherwise more easily removed by detersive solutions containing said proteases.

Suitable enzymes include a protease, an amylase, a lipase, a gluconase, a cellulase, a peroxidase, an oxidase, a mannanase, a pectate lyase, or a mixture thereof. In a preferred aspect, the combination of enzymes includes a protease and a lipase. In a further preferred aspect, the combination of enzymes includes a protease, a lipase and/or an amylase.

Enzymes suitable for use according to the invention may be from a variety of origins, such as vegetable, animal, bacterial, fungal or yeast origin. Preferred selections are influenced by factors such as pH-activity and/or stability optima, thermostability, and stability to active detergents, builders and the like. In an aspect, bacterial or fungal enzymes are preferred.

A valuable reference on enzymes is "Industrial Enzymes," Scott, D., in Kirk-Othmer Encyclopedia of Chemical Technology, 3rd Edition, Vol. 9, pp. 173-224, John Wiley & Sons, New York, 1980, which is herein incorporated herein by reference in its entirety. Additional description of suitable enzymes, include certain stabilized enzymes, is provided in U.S. patent application Ser. No. 12/934,355, which is herein incorporated by reference in its entirety.

In an aspect, the compositions may include at least 0.1-50 wt-% enzymes, at least 1-20 wt-% enzymes, preferably at least 1-10 wt-% enzymes. In an aspect, the compositions include a mixture of more than one class of enzymes (e.g. a combination of a protease, a lipase and an amylase, or a combination of a protease and a lipase). In another aspect, the compositions include a combination of enzymes wherein the ratio of enzymes (e.g. protease to lipase) is from about 1:1 to about 10:1, from about 1:1 to about 5:1. In a further aspect, the compositions include a combination of enzymes wherein the ratio of enzymes (e.g. protease to lipase) is from about 1:1 to about 1:10, from about 1:1 to about 1:5. Without being limited to a particular theory of the invention, the ratio of the classes of enzymes combined in a composition according to the invention is not intended to limit the scope of the invention, whereas the ratio of enzyme stabilizing agent to enzymes is the focus of the present invention.

Protease

Suitable protease enzymes can be derived from a plant, an animal, or a microorganism. Preferably the protease is derived from a microorganism, such as a yeast, a mold, or a bacterium. Preferred proteases include serine proteases active at alkaline pH, preferably derived from a strain of *Bacillus* such as *Bacillus subtilis* or *Bacillus licheniformis*; these preferred proteases include native and recombinant subtilisins. The protease can be purified or a component of a microbial extract, and either wild type or variant (either chemical or recombinant). Examples of proteolytic enzymes include (with trade names) Coronase®; Savinase®; a protease derived from *Bacillus lentus* type, such as Maxacal®, Opticlean®, Durazym®, and Properase®; a protease derived from *Bacillus licheniformis*, such as Alcalase® and Maxatase®; and a protease derived from *Bacillus amyloliquefaciens*, such as Primase®. Commercially available protease enzymes include those sold under the trade names Coronase®, Alcalase®, Savinase®, Primase®, Durazym®, or Esperase® by Novozymes A/S (Denmark); those sold under the trade names Maxatase®, Maxacal®, or Maxapem® by Gist-Brocades (Netherlands); those sold under the trade names Purafect®, Purafect OX, and Properase by Genencor International; those sold under the trade names Opticlean® or Optimase® by Solvay Enzymes; and the like.

A mixture of such proteases can also be used. For example, Purafect® is an alkaline protease (a subtilisin) having application in lower temperature cleaning programs, from about 30° C. to about 65° C.; whereas, Esperase® is an alkaline protease of choice for higher temperature detersive solutions, from about 50° C. to about 85° C. Detersive proteases are described in patent publications, which are incorporated herein by reference in its entirety, including: GB 1,243,784, WO 9203529 A (enzyme/inhibitor system), WO 9318140 A, and WO 9425583 (recombinant trypsin-like protease) to Novo; WO 9510591 A, WO 9507791 (a protease having decreased adsorption and increased hydrolysis), WO 95/30010, WO 95/30011, WO 95/29979, to Procter & Gamble; WO 95/10615 (*Bacillus amyloliquefa-*

*ciens* subtilisin) to Genencor International; EP 130,756 A (protease A); EP 303,761 A (protease B); and EP 130,756 A. A variant protease is preferably at least 80% homologous, preferably having at least 80% sequence identity, with the amino acid sequences of the proteases in these references.

Naturally, mixtures of different proteolytic enzymes may be used. While various specific enzymes have been described above, it is understood that any protease which can confer the desired proteolytic activity to the composition may be used.

Lipases

A suitable lipase can be derived from a plant, an animal, or a microorganism. Preferably the lipase is derived from a microorganism, such as a fungus or a bacterium. Preferred lipases include those derived from a *Pseudomonas*, such as *Pseudomonas stutzeri* ATCC 19.154, or from a *Humicola*, such as *Humicola lanuginosa* (typically produced recombinantly in *Aspergillus oryzae*). The lipase can be purified or a component of an extract, and either wild type or variant (either chemical or recombinant).

Examples of lipase enzymes that can be used include those sold under the trade names Lipase P "Amano" or "Amano-P" by Amano Pharmaceutical Co. Ltd., Nagoya, Japan or under the trade name Lipolase® by Novo, and the like. Other commercially available lipases that can be used include Amano-CES, lipases derived from *Chromobacter viscosum*, e.g. *Chromobacter viscosum* var. *lipoyticum* NRRLB 3673 from Toyo Jozo Co., Tagata, Japan; *Chromobacter viscosum* lipases from U.S. Biochemical Corp., U.S.A. and Disoynth Co., and lipases derived from *Pseudomonas gladioli* or from *Humicola lanuginosa.*

A preferred lipase is sold under the trade name Lipex® by Novozymes A/S. Additional suitable lipases are described in patent documents, which are herein incorporated by reference in their entirety, including: WO 9414951 A (stabilized lipases) to Novo, WO 9205249, RD 94359044, GB 1,372,034, Japanese Patent Application 53,20487, laid open Feb. 24, 1978 to Amano Pharmaceutical Co. Ltd., and EP 341,947.

Naturally, mixtures of different lipase enzymes can be used. While various specific enzymes have been described above, it is to be understood that any lipase which can confer the desired lipase activity to the composition can be used.

Amylase

Suitable amylase enzymes can be derived from a plant, an animal, or a microorganism. Preferably the amylase is derived from a microorganism, such as a yeast, a mold, or a bacterium. Amylases include those derived from a *Bacillus*, such as *B. licheniformis, B. amyloliquefaciens, B. subtilis*, or *B. stearothermophilus*. The amylase can be purified or a component of a microbial extract, and either wild type or variant (either chemical or recombinant), preferably a variant that is more stable under washing or presoak conditions than a wild type amylase.

Examples of amylase enzymes include those sold under the trade name Rapidase by Gist-Brocades® (Netherlands); those sold under the trade names Termamyl®, Fungamyl® or Duramyl® by Novo; Purastar STL or Purastar OXAM by Genencor; and the like. Preferred commercially available amylase enzymes include the stability enhanced variant amylase sold under the trade name Duramyl® by Novo. A mixture of amylases can also be used.

Suitable amylases include: I-amylases described in WO 95/26397, PCT/DK96/00056, and GB 1,296,839 to Novo; and stability enhanced amylases described in J. Biol. Chem., 260(11):6518-6521 (1985); WO 9510603 A, WO 9509909 A and WO 9402597 to Novo; references disclosed in WO 9402597; and WO 9418314 to Genencor International. Each of these references is herein incorporated by reference in their entirety. A variant I-amylase is preferably at least 80% homologous, preferably having at least 80% sequence identity, with the amino acid sequences of the proteins of these references.

Naturally, mixtures of different amylase enzymes can be used. While various specific enzymes have been described above, it is understood that any amylase which can confer the desired amylase activity to the composition can be used.

Cellulases

Suitable cellulases can be derived from a plant, an animal, or a microorganism. Preferably the cellulase is derived from a microorganism, such as a fungus or a bacterium. Cellulases include those derived from a fungus, such as *Humicola insolens, Humicola* strain DSM1800, or a cellulase 212-producing fungus belonging to the genus *Aeromonas* and those extracted from the hepatopancreas of a marine mollusk, *Dolabella Auricula Solander*. The cellulase can be purified or a component of an extract, and either wild type or variant (either chemical or recombinant).

Examples of cellulase enzymes include those sold under the trade names Carezyme® or Celluzyme® by Novo, or Cellulase by Genencor; and the like. A mixture of cellulases can also be used. Suitable cellulases are described in patent documents, which are herein incorporated by reference in their entirety, including: U.S. Pat. No. 4,435,307, GB-A-2.075.028, GB-A-2.095.275, DE-OS-2.247.832, WO 9117243, and WO 9414951 A (stabilized cellulases) to Novo.

Naturally, mixtures of different cellulase enzymes can be used. While various specific enzymes have been described above, it is to be understood that any cellulase which can confer the desired cellulase activity to the composition can be used.

Additional Enzymes

Additional suitable enzymes include a cutinase, a peroxidase, a gluconase, and the like. Suitable cutinase enzymes are described in WO 8809367, which is herein incorporated by reference in its entirety. Known peroxidases include horseradish peroxidase, ligninase, and haloperoxidases such as chloro- or bromo-peroxidase. Suitable peroxidases are disclosed in WO 89099813 and WO 8909813, which are herein incorporated by reference in their entirety. Peroxidase enzymes can be used in combination with oxygen sources, e.g., percarbonate, perborate, hydrogen peroxide, and the like. Additional enzymes are disclosed in WO 9307263, WO 9307260, WO 8908694, and U.S. Pat. Nos. 3,553,139, 4,101,457, 4,507,219 and 4,261,868. Each of these references is herein incorporated by reference in their entirety.

An additional enzyme, such as a cutinase or peroxidase, can be derived from a plant, an animal, or a microorganism. Preferably the enzyme is derived from a microorganism. The enzyme can be purified or a component of an extract, and either wild type or variant (either chemical or recombinant).

Naturally, mixtures of different additional enzymes can be incorporated into this invention. While various specific enzymes have been described above, it is to be understood that any additional enzyme which can confer the desired enzyme activity to the composition can be used.

Solvents

The stabilized enzyme compositions may include a solvent or combination or solvents. The solvent has been found to positively contribute to the enzyme stability when used as part of the enzyme stabilizing system with other materials. The solvent concentration in the compositions can range from about 0.1 wt-% to about 20.0 wt-%, from about 1.0 wt-% to about 15.0 wt-%, and from about 3.0 wt-% to about 10.0 wt-%.

In an aspect, the stabilized enzyme compositions of the invention may include a non-aqueous or aqueous solvent. In further aspects, the solvents are organic molecules. Suitable solvents may include organic solvents, such as alcohols or polyols, and oxygenated solvents, such as lower alkanols, lower alkyl ethers, glycols, aryl glycol ethers and lower alkyl glycol ethers. Additional examples of useful solvents include various alcohols, including methanol, ethanol, propanol, isopropanol and butanol, isobutanol, ethylene glycol, diethylene glycol, triethylene glycol, propylene glycol, dipropylene glycol, mixed ethylene-propylene glycol ethers, ethylene glycol phenyl ether, and propylene glycol phenyl ether. Substantially water soluble glycol ether solvents include propylene glycol methyl ether, propylene glycol propyl ether, dipropylene glycol methyl ether, tripropylene glycol methyl ether, ethylene glycol butyl ether, diethylene glycol methyl ether, diethylene glycol butyl ether, ethylene glycol dimethyl ether, ethylene glycol propyl ether, diethylene glycol ethyl ether, triethylene glycol methyl ether, triethylene glycol ethyl ether, triethylene glycol butyl ether, and others.

The solvent is preferably an alcohol, which may include for example, benzyl alcohol, methanol, ethanol, propanol, butanol, and the like, as well as mixtures thereof. The solvent may also be a polyol, such as for example, glycerol, glycol ethers, ethylene glycol, propylene glycol, diethylene glycol, and the like, as well as mixtures thereof. For reasons of low cost, commercial availability, and solvent strength, benzyl alcohol is a preferred solvent. These preferred solvents help reduce surface tension and help solubilize adhesives.

In some aspects the water is included as a diluent and/or solvent for the stabilized enzyme compositions. The water can include water from any source including deionized water, tap water, softened water, and combinations thereof.

Surfactants

The stabilized enzyme compositions may include an additional surfactant to provide enhanced cleaning performance. Additional detergency or cleaning efficacy for the stabilized enzyme compositions can be obtained from the use of additional surfactant materials. Various types of surfactants may be formulated into the stabilized enzyme compositions of the invention. Surfactants suitable for use with the compositions of the present invention include, but are not limited to, anionic surfactants, nonionic surfactants, amphoteric surfactants and/or zwitterionic surfactants.

In some embodiments, the stabilized enzyme compositions of the present invention include about 0.01 wt-% to about 50 wt-% of additional surfactants. In other embodiments the stabilized enzyme compositions include about 1 wt-% to about 30 wt-% of additional surfactant, preferably about 1 wt-% to about 20 wt-% of additional surfactant.

Anionic Surfactants

In some embodiments, the stabilized enzyme compositions of the present invention include an additional surfactant that is an anionic surfactant. Anionic sulfate surfactants suitable for use in the present compositions include alkyl ether sulfates, alkyl sulfates, the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside, and the like. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule).

Anionic sulfonate surfactants suitable for use in the present compositions also include alkyl sulfonates, the linear and branched primary and secondary alkyl sulfonates, and the aromatic sulfonates with or without substituents.

Anionic carboxylate surfactants suitable for use in the present compositions include carboxylic acids (and salts), such as alkanoic acids (and alkanoates), ester carboxylic acids (e.g. alkyl succinates), ether carboxylic acids, and the like. Such carboxylates include alkyl ethoxy carboxylates, alkyl aryl ethoxy carboxylates, alkyl polyethoxy polycarboxylate surfactants and soaps (e.g. alkyl carboxyls). Secondary carboxylates useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary carboxylate surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present. Suitable carboxylates also include acylamino acids (and salts), such as acylgluamates, acyl peptides, sarcosinates (e.g. N-acyl sarcosinates), taurates (e.g. N-acyl taurates and fatty acid amides of methyl tauride), and the like.

Suitable anionic surfactants include alkyl or alkylaryl ethoxy carboxylates of the following formula:

$$R—O—(CH_2CH_2O)_n(CH_2)_m—CO_2X \quad (3)$$

in which R is a $C_8$ to $C_{22}$ alkyl group or

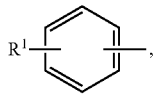

in which $R^1$ is a $C_4$-$C_{16}$ alkyl group; n is an integer of 1-20; m is an integer of 1-3; and X is a counter ion, such as hydrogen, sodium, potassium, lithium, ammonium, or an amine salt such as monoethanolamine, diethanolamine or triethanolamine. In some embodiments, n is an integer of 4 to 10 and m is 1. In some embodiments, R is a $C_8$-$C_{16}$ alkyl group. In some embodiments, R is a $C_{12}$-$C_{14}$ alkyl group, n is 4, and m is 1.

In other embodiments, R is

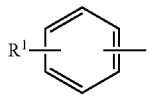

and $R^1$ is a $C_6$-$C_{12}$ alkyl group. In still yet other embodiments, $R^1$ is a $C_9$ alkyl group, n is 10 and m is 1.

Such alkyl and alkylaryl ethoxy carboxylates are commercially available. These ethoxy carboxylates are typically available as the acid forms, which can be readily converted to the anionic or salt form. Commercially available carboxylates include, Neodox 23-4, a $C_{12-13}$ alkyl polyethoxy (4) carboxylic acid (Shell Chemical), and Emcol CNP-110, a $C_9$ alkylaryl polyethoxy (10) carboxylic acid (Witco Chemical).

Carboxylates are also available from Clariant, e.g. the product Sandopan® DTC, a $C_{13}$ alkyl polyethoxy (7) carboxylic acid.

Nonionic Surfactants

In some embodiments, the stabilized enzyme compositions of the present invention include an additional surfactant that is a nonionic surfactant. Suitable nonionic surfactants suitable for use with the compositions of the present invention include alkoxylated surfactants. Suitable alkoxylated surfactants include EO/PO copolymers, capped EO/PO copolymers, alcohol alkoxylates, capped alcohol alkoxylates, mixtures thereof, or the like. Suitable alkoxylated surfactants for use as solvents include EO/PO block copolymers, such as the Pluronic and reverse Pluronic surfactants; alcohol alkoxylates, such as Dehypon LS-54 (R-$(EO)_5(PO)_4$) and Dehypon LS-36 (R-$(EO)_3(PO)_6$); and capped alcohol alkoxylates, such as Plurafac LF221 and Tegoten EC11; mixtures thereof, or the like.

The semi-polar type of nonionic surface active agents is another class of nonionic surfactant useful in compositions of the present invention. Semi-polar nonionic surfactants include the amine oxides, phosphine oxides, sulfoxides and their alkoxylated derivatives.

Amine oxides are tertiary amine oxides corresponding to the general formula:

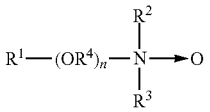

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkylene or a hydroxyalkylene group containing 2 to 3 carbon atoms; and n ranges from 0 to about 20. An amine oxide can be generated from the corresponding amine and an oxidizing agent, such as hydrogen peroxide.

Useful water soluble amine oxide surfactants are selected from the octyl, decyl, dodecyl, isododecyl, coconut, or tallow alkyl di-(lower alkyl) amine oxides, specific examples of which are octyldimethylamine oxide, nonyldimethylamine oxide, decyldimethylamine oxide, undecyldimethylamine oxide, dodecyldimethylamine oxide, isododecyldimethyl amine oxide, tridecyldimethylamine oxide, tetradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl) amine oxide, 3,6,9-trioctadecyldimethylamine oxide and 3-dodecoxy-2-hydroxypropyldi-(2-hydroxyethyl)amine oxide.

Amphoteric Surfactants

In some embodiments, the stabilized enzyme compositions of the present invention include an additional surfactant that is an additional amphoteric surfactant. Suitable amphoteric surfactants are disclosed herein with respect to the enzyme stabilizer. Encompassed within the scope of the invention are stabilized compositions including more than one amphoteric surfactant.

Zwitterionic Surfactants

In some embodiments, the stabilized enzyme compositions of the present invention include an additional surfactant that is a zwitterionic surfactant. Zwitterionic surfactants can be thought of as a subset of the amphoteric surfactants and can include an anionic charge. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. Betaine and sultaine surfactants are exemplary zwitterionic surfactants for use herein.

A general formula for these compounds is:

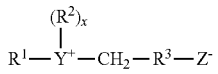

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

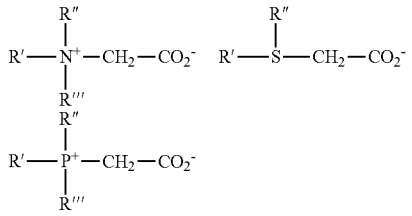

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present invention include those compounds having the formula $(R(R^1)_2N^+R^2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Additional Functional Ingredients

Besides the enzymes, stabilizing agent, surfactant and/or solvents, the compositions disclosed herein can include a number of additional functional ingredients. For the purpose of this application, the term "functional materials or ingredients" include a material that when dispersed or dissolved in a use and/or concentrate solution, provides a beneficial property in a particular use. Functional ingredients which may be employed in the stabilized enzyme compositions include, for example, any combination of sources of acid or alkalinity, additional surfactants, defoamers, rinse aids, additional antimicrobial agents, preservatives, viscosity modifiers, bleaching agents, dyes and fragrances, chelating agents and the like.

Beneficially, in some aspects the stabilized liquid enzyme compositions do not employ traditional enzyme stabilizers (e.g. boric acid or boric acid salts). In some embodiments, the composition is preferably free or substantially free of boric acid or boric acid salts.

Exemplary Compositions

Exemplary liquid stable compositions may include some or all of the following materials shown in Table 1. The compositions according to the invention include a greater amount of water content, demonstrating the actual stabilization of the enzymes, which is distinct from many other enzyme compositions. In an aspect, the compositions may include at least 20 wt-% water, at least 20 wt-% water, at least 30 wt-% water, at least 40 wt-% water, or at least 50 wt-% water.

TABLE 1

Liquid Stable Enzyme Compositions

| | | | |
|---|---|---|---|
| Enzyme | 0.01-25 wt-% | 0.1-20 wt-% | 0.1-10 wt-% |
| Enzyme Stabilizer | 1-50 wt-% | 5-50 wt-% | 10-30 wt-% |
| Surfactant | 0-50 wt-% | 1-30 wt-% | 1-20 wt-% |
| Solvent | 0.1-20 wt-% | 1-15 wt-% | 3-10 wt-% |
| Additional Functional Ingredients (e.g. Fragrances, Dyes, Preservatives, etc.) | as needed | as needed | as needed |
| Water | balance | balance | balance |

In an aspect, the ratio of amphoteric enzyme stabilizer to the enzyme is from about 64:1 to about 1:1, from about 50:1 to about 1:1, from about 20:1 to about 2.5:1, preferably from about 10:1 to about 5:1.

In a further aspect, compositions have a pH from about 4 to about 10, preferably from about 5 to about 9, and more preferably from about 6 to about 8 and most preferably a pH of about 7 (or approximately neutral).

Beneficially, the liquid stable enzyme compositions provide compositional stability for at least about 40 days, preferably more than 40 days, more than 50 days, more than 60 days, more than 100 days, still more preferably at least 6 months and most preferably at least one year. As referred to herein, compositional stability means that the enzymes in the liquid stable enzyme composition retain at least about 80% of its initial enzyme activity after 40 days at ambient temperature, preferably at least about 90% of its initial enzyme activity, preferably at least about 95% of its initial enzyme activity, and most preferably 100% of its initial enzyme activity.

The liquid stable enzyme compositions may be a variety of liquids, including for example, thickened liquid, gelled liquid, paste, or the like. Liquid compositions can typically be made by forming the ingredients in an aqueous liquid or solvent system. Such systems are typically made by dissolving or suspending the active ingredients in water or in compatible solvent and then diluting the product to an appropriate concentration, either to form a concentrate or a use solution thereof. Gelled compositions can be made similarly by dissolving or suspending the active ingredients in a compatible solvent including a gelling agent at an appropriate concentration.

The composition is preferably a liquid ready-to-use composition. A concentrate refers to a composition that is diluted to form a ready-to-use composition. A ready-to-use composition refers to a composition that is applied to the surface to be cleaned.

The liquid compositions may be provided in bulk or in unit dose. For example, the compositions may be provided in a large block compositions that may be used for many cleaning cycles. Alternatively, the composition may be provided in unit dose form wherein a new composition is provided for each new cleaning cycle. The compositions may be packaged in a variety of materials, including a water soluble film, disposable plastic container, flexible bag, shrink wrap and the like.

The liquid compositions may be provided or packaged separately or together. For example, the liquid stable enzyme composition may be provided and packaged separately from surfactants which may optionally be employed in the compositions according to the invention. Alternatively the composition components may be provided together in one package.

Methods Employing Liquid Stable Compositions for Warewashing

The disclosure generally relates to liquid stable enzyme compositions and methods of using the same for warewashing and other cleaning methods. The methods of the invention beneficially result in improved stability of the stabilized enzyme compositions. As a result, the liquid stable enzyme compositions have improved shelf-life without any substantial negative effects on the enzymes within the compositions. The methods of the invention further beneficially result in at least substantially similar cleaning performance to conventional enzyme cleaning compositions. In preferred aspects of the invention, the methods employing the liquid stable enzyme compositions result in improved soil removal and efficacy (i.e. enhance the activity of the enzymes). That is the enzymes exhibit greater activity after formulation in the liquid stable enzyme compositions of the invention than do control enzymes formulated in a control composition that does not employ the amphoteric surfactant enzyme stabilizing agent and/or is provided direct from the enzyme supplier.

The disclosure includes methods of warewashing using the liquid stable enzyme compositions. In some embodiments, the methods include applying the liquid stable enzyme compositions directly to an article to be cleaned. In other embodiments, the methods include applying the liquid stable enzyme compositions to a dishmachine sump for subsequent application to an article to be cleaned. The method of warewashing where the liquid stable enzyme composition is applied directly to the article to be cleaned obviates the dispensing of the composition into a sump and applying the composition to the article as a ready-to-use composition. Applying the composition directly to the article advantageously allows a more concentrated composition to contact the soils in need of cleaning.

In some embodiments, the methods include applying to the article a surfactant composition in addition to the liquid stable enzyme composition. In other embodiments, the surfactant and liquid stable enzyme composition are combined into a single composition for applying to the article to be cleaned. In these embodiments, the method may include additional surfactant and/or enzyme steps for cleaning of the articles. In an embodiment, the surfactant and enzyme steps are provided in an alternating pattern. In some embodiments, the method includes pauses between the alternating steps. During a pause, no further cleaning agent is applied to the article and the existing composition is allowed to stand on the dish for a period of time. In some embodiments, the method includes a rinse or rinses. Finally, in some embodiments, the method may include an optional prewash step before the treatment with the surfactant and/or enzyme composition. It is understood that the method may include as many surfactant and/or enzyme steps as desired.

According to embodiments of the invention, the liquid stable enzyme compositions may be applied to the article to be cleaned by spraying the composition through either the wash arm or the rinse arm of the dishmachine, or by spraying the composition through an additional spray arm or through spray nozzles.

The disclosed methods can be carried out in a variety of dish machines, including consumer and institutional dish machines. The time for each step in the method may vary depending on the dishmachine, for example, if the dishmachine is a consumer dishmachine or an institutional dishmachine. The time required for a cleaning step in consumer dishmachines is typically about 10 minutes to about 60 minutes. The time required for the cleaning cycle in a U.S. or Asian institutional dishmachine is typically about 45 seconds to about 2 minutes, depending on the type of machine. Each method step preferably last from about 2 seconds to about 30 minutes.

Preferably, the cleaning employing the liquid stable enzyme composition for removal of various soils, namely fatty soils, is completed in less than 60 minutes, and more preferably less than 30 minutes.

As used herein, ambient temperature refers to the temperature of the surroundings of the liquid stabilized enzyme composition under normal conditions for storage or transportation. Although the compositions may be stored and transported at temperatures in the range of about −10° F. to about 100° F., ambient temperatures preferably refers to room temperatures of about 72° F. or 25° C.

Beneficially, according to an aspect of the invention, the stabilized liquid enzyme compositions have improved low temperature stability. In an aspect, the temperature of the cleaning solutions may be from about 70° F. to about 120° F., preferably from about 80° F. to about 110° F. It is an unexpected benefit according to the invention that the compositions may be employed in both manual dishmachines and at low or ambient temperatures.

However, as one skilled in the art will ascertain, the temperature of the cleaning solutions in each step may also vary depending on the dishmachine, for example, if the dishmachine is a consumer dishmachine or an institutional dishmachine. The temperature of the cleaning solution in a consumer dishmachine is typically about 110° F. (43° C.) to about 150° F. (66° C.) with a rinse up to about 160° F. (71° C.). The temperature of the cleaning solution in a high temperature institutional dish machine in the U.S. is typically about 150° F. (66° C.) to about 165° F. (74° C.) with a rinse from about 180° F. (82° C.) to about 195° F. (91° C.). The temperature of a low temperature institutional dishmachine in the U.S. is typically about 120° F. (49° F.) to about 140° F. (60° C.). Low temperature dishmachines usually include at least a seven minute rinse with a sanitizing solution. The temperature in a high temperature institutional dishmachine in Asia is typically from about 131° F. (55° C.) to about 136° F. (58° C.) with a final rinse at 180° F. (82° C.).

Dish Machines

The disclosed methods may be carried out in any consumer or institutional dish machine. Some non-limiting examples of dish machines include door machines or hood machines, conveyor machines, undercounter machines, glasswashers, flight machines, pot and pan machines, utensil washers, and consumer dish machines. The dish machines may be either single tank or multi-tank machines.

A door dish machine, also called a hood dish machine, refers to a commercial dish machine wherein the soiled dishes are placed on a rack and the rack is then moved into the dish machine. Door dish machines clean one or two racks at a time. In such machines, the rack is stationary and the wash and rinse arms move. A door machine includes two sets arms, a set of wash arms and a rinse arm, or a set of rinse arms. Door machines may be a high temperature or low temperature machine. In a high temperature machine the dishes are sanitized by hot water. In a low temperature machine the dishes are sanitized by the chemical sanitizer. The door machine may either be a recirculation machine or a dump and fill machine. In a recirculation machine, the detergent solution is reused, or "recirculated" between wash cycles. The concentration of the detergent solution is adjusted between wash cycles so that an adequate concentration is maintained. In a dump and fill machine, the wash solution is not reused between wash cycles. New detergent solution is added before the next wash cycle. Some non-limiting examples of door machines include the Ecolab Omega HT, the Hobart AM-14, the Ecolab ES-2000, the Hobart LT-1, the CMA EVA-200, American Dish Service L-3DW and HT-25, the Autochlor A5, the Champion D-HB, and the Jackson Tempstar.

The disclosed methods may also be used in a pot and pan washer, a utensil washer, glasswashers and/or a conveyor machine. A conveyor machine refers to a commercial dish machine, wherein the soiled dishes are placed on a rack that moves through a dish machine on a conveyor. A conveyor machine continuously cleans racks of soiled dishes instead of one rack at a time. Here the manifolds are typically stationary or oscillating and the rack moves through the machine. A conveyor machine may be a single tank or multi-tank machine. The conveyor machine may include a prewash section. A conveyor machine may be a high temperature or low temperature machine. Finally, conveyor machines primarily recirculate the detergent solution. Some non-limiting examples of conveyor machines include the Ecolab ES-4400, the Jackson AJ-100, the Stero SCT-44, and the Hobart C-44, and C-66.

The disclosed methods may also be used in an undercounter machine. An undercounter machine refers to a dish machine similar to most consumer dish machines, wherein the dish machine is located underneath a counter and the dishes are cleaned one rack at a time. In an undercounter dish machine, the rack is stationary and the wash/rinse arms are moving. Undercounter machines may be a high temperature or low temperature machine. The undercounter machine may either be a recirculation machine or a dump and fill machine. Some non-limiting examples of undercounter machines include the Ecolab ES-1000, the Jackson JP-24, and the Hobart LX-40H.

The disclosed methods may also be used in a flight machine. A flight machine refers to a commercial dish machine, wherein the soiled dishes are placed on pegs that move through a dish machine on a conveyor. A flight machine continuously cleans soiled dishes and racks are not used. Here the manifolds are typically stationary or oscillating and the conveyor moves through the machine. A flight machine is typically a multi-tank machine. The flight machine may include a prewash section. A flight machine is typically a high temperature machine. Finally, flight machines typically recirculate the detergent solution. Some non-limiting examples of flight machines include the Meiko BA Series and the Hobart FT-900.

Use of the various described dish machines will also employ a dispenser for dispensing the liquid stable enzyme compositions. The dispenser may be selected from a variety of dispensers depending on the physical form of the composition. For example, a liquid composition may be dispensed using a pump, either peristaltic or bellows for example, syringe/plunger injection, gravity feed, siphon feed, aspirators, unit dose, for example using a water soluble packet such as polyvinyl alcohol or a foil pouch, evacuation from a pressurized chamber, or diffusion through a membrane or permeable surface. If the composition is a gel or a thick liquid, it may be dispensed using a pump such as a peristaltic or bellows pump, syringe/plunger injection, caulk gun, unit dose, for example, using a water soluble packet such as polyvinyl alcohol or a foil pouch, evacuation from a pressurized chamber, or diffusion through a membrane or permeable surface. The dispenser may also be a dual dispenser in which the stabilized enzyme composition is dispensed on one side, and the surfactant composition is dispensed on the other side. These dispensers may be located in the dish machine, outside of the dish machine, or remote from the dish machine. Finally, a single dispenser may feed one or more dish machines.

It is understood that the dish machines described herein may be used in conjunction with the disclosed methods. Additionally, the dish machines may be modified as described and used with a different method of cleaning. For example, instead of using the methods in a modified dish machine, a different detergent, for example, a special surfactant package, rinse aid, or the like, may be run through the modified dish machine, for example through the additional wash or rinse arms, or spray nozzles.

Additional Methods Employing Liquid Stable Compositions

The disclosure also relates to using the liquid stable enzyme compositions for cleaning surfaces in various institutional settings. In the foodservice industry, for example, food soils include protein, fats and oils, and starches. These soils end up on hard surfaces in a kitchen and restaurant such as the floors, walls, countertops, and dishes. They also end up on soft surfaces like bar rags, towels, and mop heads. The liquid stable enzyme compositions are particularly suited for use in the various institutional settings.

The disclosure also relates to using the liquid stable enzyme compositions for textile applications, healthcare and other hard surface cleaning applications. The disclosure still further relates to the use of enzymes for certain car care applications. Still further, the disclosure relates to the use of enzymes for oil and gas field applications. In all of the applications of use according to the invention, the methods beneficially result in improved stability and efficacy of enzymes for soil removal in a broad variety of cleaning applications, pHs and temperature ranges.

The stabilized enzyme compositions can be incorporated into cleaning compositions which can be used as a laundry detergent, sanitizer or laundry pre-soak, a manual or automatic dishwashing or warewashing detergent or sanitizer, a sanitizer or detergent for medical instruments and equipment including manual instrument applications and automatic endoscope reprocessors, a floor cleaning composition, a clean-in-place composition (i.e., for cleaning food and beverage or pharmaceutical equipment), a cleaning composition for oil and gas field applications, and the like. The system can also be incorporated into an antimicrobial composition.

The use of the liquid stable enzyme compositions according to the invention are suitable for a variety of cleaning applications, which may include for example, disinfectants, sanitizers, sporicides and the like.

In an aspect the stabilized enzyme compositions are particularly suitable for use in applications requiring an improved degree of stain removal and/or whiteness (bleaching), such as that employing a synergistic combination of enzymes. As a result, the enzyme stabilizing agent according to the invention is added to a combination of enzymes for such formulation and providing stability of the composition to provide such synergy.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

The materials used in the following Examples are provided herein:

Amphosol® 2C: Disodium CocaAmphoDiacetate (CADA-38%), commercially available from Stepan Company—Corporate Headquarters, 22 W. Frontage Road, Northfield, Ill. 60093, United States.

Ammonyx® LMDO: lauramidopropylamine/myristamidopropylamine oxide, commercially available from Stepan Company.

Glucopon® 425N: alkyl polyglycosides, C8-C14 natural fatty alcohol based surfactant, commercially available from Stepan Company.

Lipex 1OOL: Lipase enzyme (EC 3.1.1.3), commercially available from Novozymes A/S, Krogshoejvej 36, 2880 Bagsvaerd, Denmark.

Coronase: Protease enzyme (an experimental stabilized product), available from Novozymes A/S as described more fully in U.S. patent application Ser. No. 12/934,355. The Coronase provide is available in both a standard and Ultra version and is most effective in removing stains in laundry applications (e.g. grass and blood stains).

Esperase: Protease enzyme, Subtilisin (EC 3.4.21.62), commercially available from Novozymes A/S.

Savinase: Protease enzyme, Subtilisin (EC 3.4.21.62), commercially available from Novozymes A/S.

Neolone M-1O: 2-Methyl-4-Isothiazolin-3-one preservative, commercially available from Dow Chemical Co, 2020 Abbott Rd, Midland, Mich. 48674.

Additional materials which are readily commercially-available include for example, benzyl alcohol, fragrances, dyes and sodium chloride.

Example 1

Various formulations of liquid compositions having a mixture of enzymes in need of stabilization were evaluated. Tables 2 and 3 show formulations using a mixture of lipase and protease enzymes without the inclusion of the disodium cocacamphodiacetate stabilizing agent. Both formulations were considered non-stable as the enzyme compositions lost performance after approximately 21 and 6 days, respectively, at room temperature.

TABLE 2

| Raw Material | Wt-% |
|---|---|
| Deionized Water | 58.62 |
| Ammonyx LMDO (Stepan) | 5.11 |
| Glucopon 425N | 30.13 |
| Lipex 100L | 1.53 |
| Protease | 1.55 |
| Benzyl Alcohol | 3.06 |

TABLE 3

| Raw Material | Wt-% |
|---|---|
| Deionized Water | 58.47 |
| Ammonyx LMDO | 5.00 |
| Glucopon 425N | 30.00 |
| Lipex 100L | 1.77 |
| Esperase | 1.77 |
| Benzyl Alcohol | 3.00 |

Figure 2:
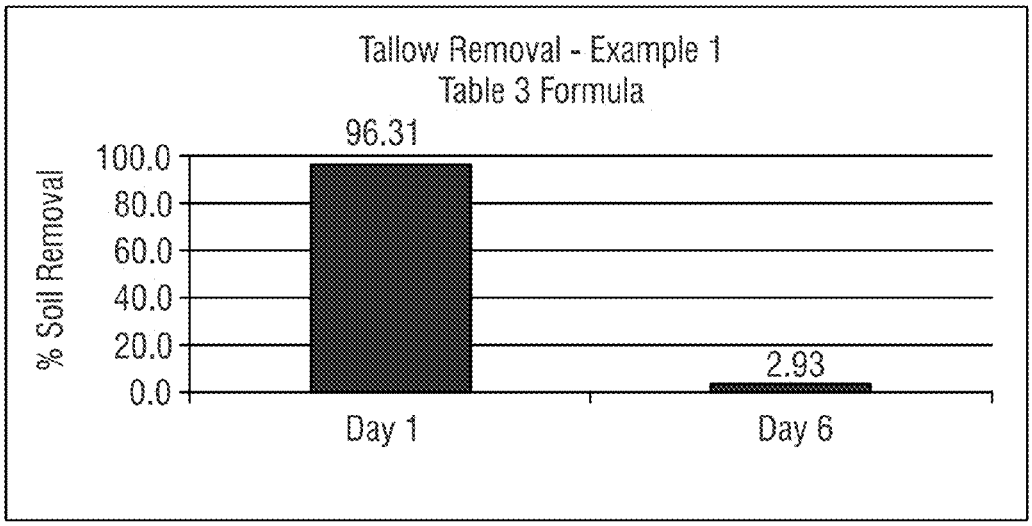

The percentage of soil removal obtained from the formulas of Tables 2 and 3 are shown in FIGS. 1 and 2. ASTM Method 122G for cleaning tests were employed using tallow soils. Although the non-stabilized enzyme compositions provided sufficient soil removal on day 1 of formulation, the formulation of Table 2 was unable to remove soil at 21 and the formulation of Table 3 was unable to remove soil at day 6, demonstrating the significant loss in stability of the compositions. The results are consistent with the scope of the present invention requiring a stabilizing agent for the combination of enzymes in the tested compositions. The combination of a lipase and protease result in a lack of activity over time to the protease enzyme digesting the lipase (or other enzymes) in a composition that is not stabilized according to the invention.

Example 2

A series of formulations employing the disodium cocacamphodiacetate stabilizing agent according to the invention were evaluated for effect on the enzyme stability in comparison to the non-stabilized compositions of Example 1. The formulations as shown in Table 4 did not lose any enzyme performance within the forty-five day evaluation period demonstrating significant stability in comparison to the formulations of Tables 2 and 3 not including the disodium cocacamphodiacetate enzyme stabilizing agent.

TABLE 4

| Raw Material | A Wt-% | B Wt-% | C Wt-% |
|---|---|---|---|
| Deionized Water | 40-45 | 40-45 | 40-45 |
| Ammonyx LMDO | 1-5 | 1-3 | 1-5 |
| Glucopon 425N | 25-35 | 25-35 | 25-35 |
| Sodium Chloride | 1-5 | 1-5 | 1-5 |
| CADA (38%) | 10-20 | 10-20 | 10-20 |
| Lipex 100L | 0 | 0.05-1 | 0.05-1 |
| Coronase | 1-5 | 0.05-1 | 0 |
| Savinase | 0 | 0 | 0 |
| Esperase | 0 | 0 | 0.05-1 |
| Benzyl Alcohol | 1-5 | 1-5 | 1-5 |
| Other (dye, fragrance, preservative) | 0.05-2 | 0.05-2 | 0.05-2 |

Figure 3:
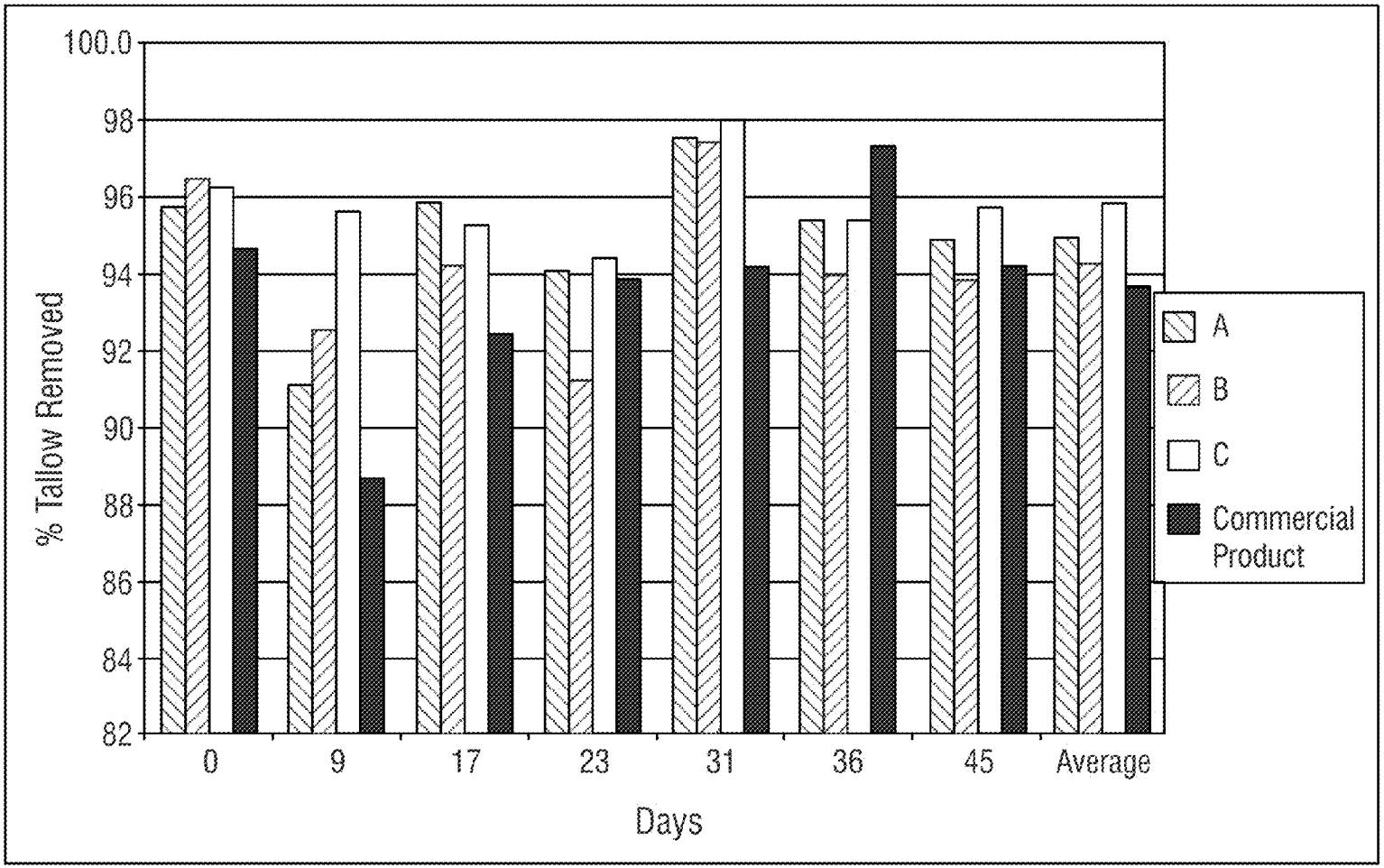
FIG. 3 shows the cleaning efficacy of various formulations over a forty-five day period demonstrating the prolonged stability at room temperature of the stabilized enzyme compositions according to an embodiment of the invention.

The cleaning efficacy of the 3 formulations are shown in FIG. 3 where the percentage tallow removed over a forty-five day period demonstrate prolonged stability at room temperature. ASTM Method 112G for cleaning testing was employed using tallow soils. The efficacy is shown in comparison to the concentrated (e.g. low water content) commercial product Dawn Professional.

The inventions being thus described, it will be obvious that the same may be varied in many ways. Such variations are not to be regarded as a departure from the spirit and scope of the inventions and all such modifications are intended to be included within the scope of the following claims. Since many embodiments can be made without departing from the spirit and scope of the invention, the invention resides in the claims.

What is claimed is:

1. A stabilized liquid enzyme composition comprising:

from about 1 wt-% to about 50 wt-% of an enzyme stabilizing agent, wherein said agent is disodium camphodiacetate; and from about 0.01 wt-% to about 25 wt-% a combination of more than one enzymes comprising at least one protease, wherein the composition retains at least about 80% of its initial enzyme activity after 40 days at ambient temperature; and wherein the composition is substantially free of organic monocarboxylic acids, boric acid, and borate salts.

2. The composition of claim 1, wherein the enzyme stabilizing agent is in an amount of from about 3.8 wt-% to about 7.6 wt-%.

3. The composition of claim 1, wherein the combination of more than one enzyme is in an amount of from about 0.05 wt-% to about 5 wt-%.

4. The composition of claim 1, wherein the enzymes are the protease, a lipase and an amylase.

5. The composition of claim 1, wherein the enzymes are the protease and a lipase.

6. The composition of claim 1, wherein the ratio of the enzyme stabilizing agent to the enzymes is from about 64:1 to about 1:1.

7. The composition of claim 1, further comprising a surfactant, wherein said surfactant is an anionic, nonionic, amphoteric and/or zwitterionic surfactant.

8. A stabilized liquid enzyme composition comprising:

from about 1 wt-% to about 50 wt-% of disodium camphodiacetate;

from about 0.01 wt-% to about 25 wt-% of a combination of more than one enzyme comprising at least one protease; and a solvent;

wherein the composition retains at least about 80% of its initial enzyme activity after 40 days at ambient temperature, wherein the composition is substantially free of organic monocarboxylic acids, boric acid, and borate salts, and wherein the ratio of the enzyme stabilizing agent to the enzymes is from about 64:1 to about 1:1.

9. The composition of claim 8, wherein the enzyme stabilizing agent is from about 3.8 wt-% to about 7.6 wt-% of the composition, and wherein the enzymes are from about 0.05 wt-% to about 5 wt-% of the composition.

10. The composition of claim 8, wherein the ratio of the enzyme stabilizing agent to the enzymes is from about 10:1 to about 2.5:1.

11. The composition of claim 8, wherein the enzymes are the protease and a lipase.

12. The composition of claim 8, wherein the enzyme stabilizing agent is from about 5 wt-% to about 50 wt-% of the composition, wherein the enzymes are from about 0.1 wt-% to about 20 wt-% of the composition, and wherein the solvent is from about 0.1 wt-% to about 20 wt-% of the composition.

13. The composition of claim 8, further comprising from about 1 wt-% to about 30 wt-% of a surfactant, wherein said surfactant is an anionic, nonionic, amphoteric and/or zwitterionic surfactant.

14. The composition of claim 8, wherein the compositional stability is measured by the enzymes in the composition retaining at least about 90% of its initial enzyme activity after 40 days at ambient temperature.

15. A method of cleaning comprising:

applying a liquid stable enzyme composition to an article to be cleaned, wherein the liquid stable enzyme composition comprises from about 1 wt-% to about 50 wt-% of an enzyme stabilizing agent that is disodium camphodiacetate, from about 0.01 wt-% to about 25 wt-% of a combination of enzymes including a protease enzyme, and a solvent, wherein the composition retains at least about 80% of its initial enzyme activity after 40 days at ambient temperature, wherein the ratio the enzyme stabilizing agent to the enzymes is from about 64:1 to about 1:1, and wherein the composition is substantially free of organic monocarboxylic acids, boric acid, and borate salts.

16. The method of claim 15, further comprising a first step of providing a liquid stable enzyme composition, wherein the enzyme stabilizing agent prevents the protease enzyme from deactivating the additional enzyme(s).

17. The method of claim 15, wherein the article is cleaned at ambient temperatures.

18. The method of claim 15, wherein the enzyme stabilizing agent is in an amount from about 3.8 wt-% to about 7.6 wt-% of the composition, wherein the enzymes are proteases and lipases in an amount form about 0.05 wt-% to about 5 wt-% of the composition, and wherein the ratio the enzyme stabilizing agent to the enzymes is from about 10:1 to about 2.5:1.

19. The method of claim 15, wherein the compositional stability is measured by the enzymes in the composition retaining at least about 90% of its initial enzyme activity after 40 days at ambient temperatures.

* * * * *